United States Patent [19]

Lancaster

[11] Patent Number: 4,756,143

[45] Date of Patent: Jul. 12, 1988

[54] LOWER GUIDED LOWER DRIVEN WRAPPING DEVICE

[75] Inventor: William G. Lancaster, Louisville, Ky.

[73] Assignee: Lantech, Inc., Louisville, Ky.

[21] Appl. No.: 19,176

[22] Filed: Feb. 26, 1987

[51] Int. Cl.[4] ..... B65B 11/02

[52] U.S. Cl. ..... 53/556; 53/588

[58] Field of Search ..... 53/556, 588, 210, 204

[56] References Cited

U.S. PATENT DOCUMENTS

| | | | |
|---|---|---|---|
| 3,864,191 | 2/1975 | Tovarys | 53/588 X |
| 4,067,174 | 1/1978 | Goldstein | 53/588 X |
| 4,209,961 | 7/1980 | Donnelley | 53/588 |

FOREIGN PATENT DOCUMENTS

| | | | |
|---|---|---|---|
| 125187 | 11/1978 | Japan | 53/588 |

*Primary Examiner*—John Sipos

*Attorney, Agent, or Firm*—Finnegan, Henderson, Farabow, Garrett & Dunner

[57] ABSTRACT

A device for wrapping a load with a web includes a web dispenser, a frame for supporting and carrying the web dispenser in the path around the load including a first track extending along substantially less than the full angular extent of the path, and a second track extending along substantially less than the full angular extent of the path and complementary to the first track for engaging and guiding the first track means along the path.

14 Claims, 3 Drawing Sheets

FIG 3
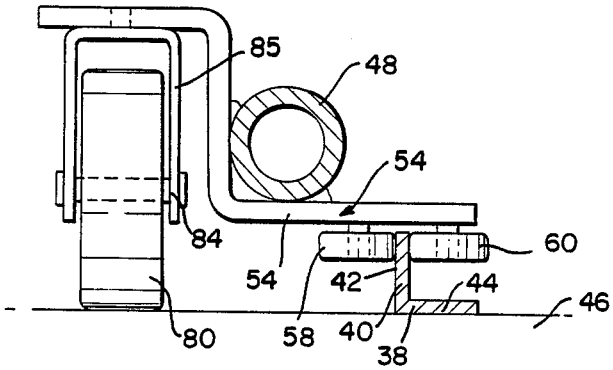
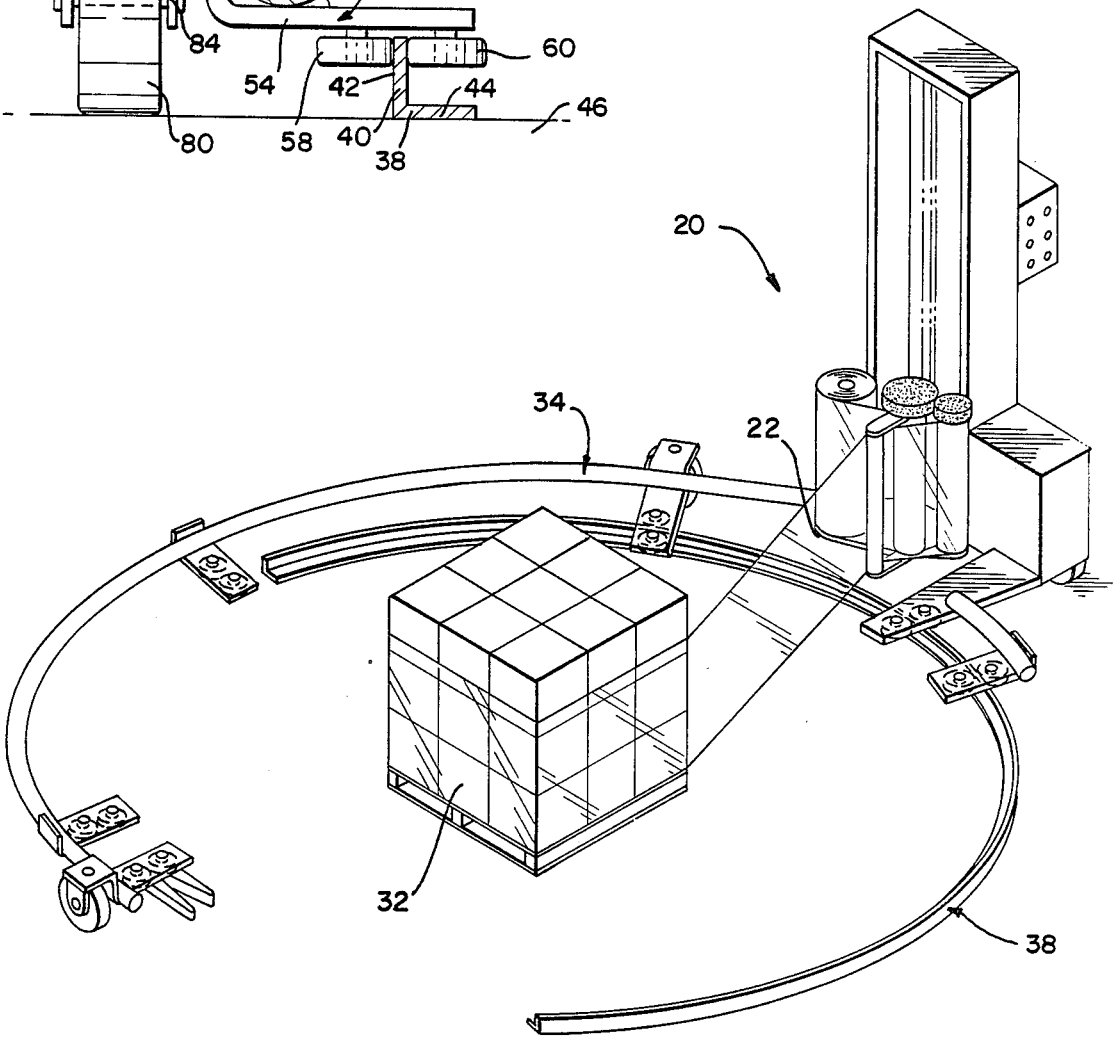
FIG 4

LOWER GUIDED LOWER DRIVEN WRAPPING DEVICE

BACKGROUND OF THE INVENTION

The present invention relates to a stretch wrapping device for wrapping for a film web around a load in an packaging operation.

A variety of stretch wrapping machines have been developed to wrap a load with a stretched film web in order to contain and cover the load. One of the most popular uses of stretch wrapping is to unitize a number of small packages with a pallet base so that they can be handled together as a larger unit.

Extremely effective stretch wrapping devices are available to perform this function such as those shown in U.S. Pat. Nos. 4,418,510 and 4,302,920 to Lancaster et al., and assigned to Lantech, Inc., which are incorporated herein by reference. However, a need has existed for a simplified inexpensive stretch wrapping device which does not have to be supported by a strong and extensive structural framework, yet which is durable and reliable in operation.

There also exists a need for a stretch wrapping device which occupies little or no floor space and which provides little or no obstruction on the floor so as not to interfere with positioning the pallet load in the wrapping position and so as not to interfere with other operations taking place in the vicinity of the stretch wrapping device.

There is also a need for a stretch wrapping device which accurately and reliably carries a web dispenser around a stationary load without the need for independent guidance from an operator while providing unobstructed access to the wrapping area.

There is a further need for a low profile stretch wrapping device which does not need support or guidance from above while being reliably guided around a load during wrapping.

Accordingly, it is an object of the present invention to provide a simplified inexpensive stretch wrapping device which does not have to be supported by a strong and extensive structural framework, yet which is durable and reliable in operation.

It is also an object of the present invention to provide a stretch wrapping device which occupies little or no floor space and which provides little or no obstruction on the floor so as not to interfere with positioning the pallet load in the wrapping position and so as not to interfere with other operations taking place in the vicinity of the stretch wrapping device.

It is another object for the present invention to provide a stretch wrapping device which accurately and reliably carries a web dispenser around a stationary load without the need for independent guidance from an operator while providing unobstructed access to the wrapping area.

It is a further object for the present invention to provide a low profile stretch wrapping device which does not need support or guidance from above while being reliably guided around a load during wrapping.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, an apparatus is provided for wrapping a load with a web. The apparatus includes a web dispenser and frame means for carrying the web dispenser in a path around the load. The frame means includes first track means having a leading end and a trailing end. The first track means extends along substantially less than the full angular extent of the path. The apparatus also includes second track means having a leading end and a trailing end. The second track means extends along substantially less than the full angular extent of the path and is complementary to the first track means for guiding the first track means along the path.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

FIG. 3 is a sectional view taken along line A—A of FIG. 1; and

FIG. 4 is a perspective view of the arrangement illustrated in FIG. 1, shown in a third position.

DESCRIPTION OF THE PREFERRED EMBODIMENT

Reference will now be made in detail to the present preferred embodiment of the invention as illustrated in the accompanying drawings.

In accordance with the present invention, apparatus is provided for wrapping a load with a web comprising: a web dispenser; frame means for carrying the web dispenser in a path around a load, the frame means including first track means having a leading end and a trailing end, the first track means extending along substantially less than the full angular extent of the path; and second track means having a leading end and a trailing end, the second track means extending along substantially less than the full angular extent of the path and being complementary to the first track means for engaging and guiding the first track means along the path.

Figure 1:
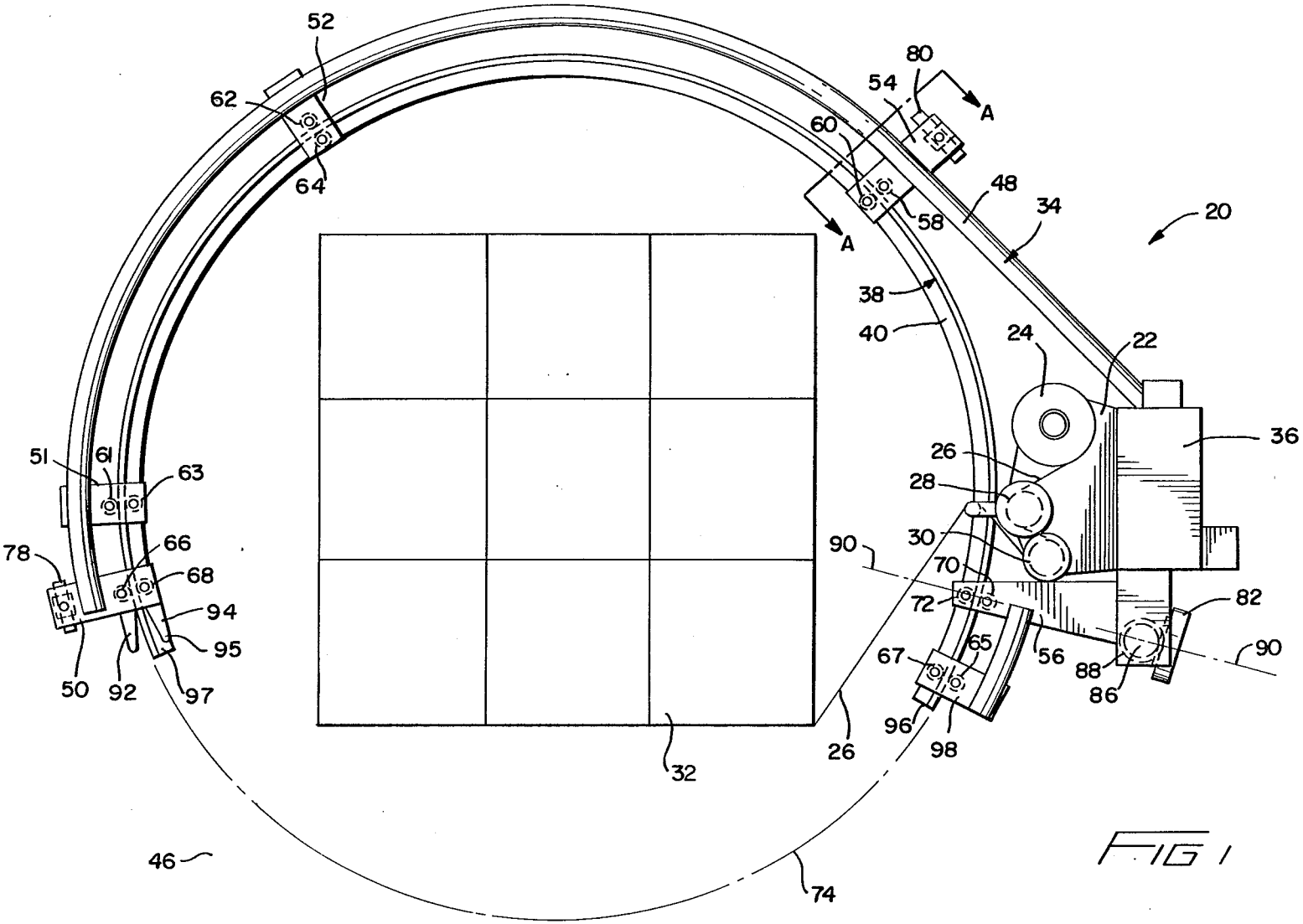
FIG. 1 is top plan view of a wrapping device in one position incorporating the teachings of the present invention.

As shown and embodied in FIGS. 1 and 4, the apparatus for wrapping a load with a web includes a stretch wrapping device 20. Stretch wrapping device 20 includes a web dispenser 22 which supports a roll 24 of conventional film web 26, and prestretch rollers 28 and 30 which stretch film web 26 before it is dispensed from film web dispenser 22 onto load 32.

According to the present invention, there is provided frame means for carrying the web dispenser in a path around the load, the frame means including first track means having a leading end and a trailing end, the first track means extending along substantially less than the full angular extent of the path. As shown and embodied in FIG. 1, the frame means includes first track means which defines a first track 34 having a leading end 95, a trailing end 98, and a support bracket 36 extending from first track 34 for supporting web dispenser 22. Support bracket 36 may include a motor driven unit to vertically translate web dispenser 22 during wrapping operations in a conventional manner to wrap loads which are taller than the effective width of the film web.

According to the present invention, there is provided second track means having a leading end and a trailing end, the second track means extending along substantially less than the full angular extent of the path and being complementary to the first track means for engaging and guiding the first track means along the path. As shown and embodied in FIG. 1, the second track means includes a second track 38 having a leading end 97 and trailing end 96.

Preferably, one of the track means includes a generally continuous engagement member and the other track means includes a spaced series of complementary engagement members. As shown and embodied in FIG. 1, said one of the track means includes second track 38 which has a generally continuous engagement member which includes an L-shaped member 40 which is attached to the floor 46 by fasteners such as bolts (not shown). L-shaped member 40 is shaped to extend along a portion, less than the full angular extent, of the desired path of the web dispenser 22 around load 32. Second track 38 forms a generally circular arc having an angular extent of approximately 225°. As shown and embodied in FIG. 3, L-shaped member includes a first flange 42 extending vertically from a horizontal second flange 44 which rests against floor 46.

As shown and embodied in FIG. 1, said other track means which includes a spaced series of complementary engagement members, includes first track 34. First track 34 includes a curved tubular rail 48 which is attached to support bracket 36 of web dispenser 22 and is also attached to track brackets 50, 51, 52, 53, 54 and 56. FIG. 3 shows track bracket 54 as S-shaped in cross-section and welded to rail 48.

Preferably, each of the spaced series of engagement members includes at least one roller, and even more preferably, at least a pair of rollers for engaging the generally continuous engagement member between them.

As shown and embodied in FIG. 1, each of the spaced series of engagement members include a pair of rollers such as rollers 58 and 60. Rollers 58 and 60 are attached to track bracket 54 and engage first flange 42 of second track 38 to guide first track 34 relative to second track 38. As shown and embodied in FIG. 1, support members 50, 52 and 56 similarly include respective rollers pairs 66 and 68, 61 and 63, 62 and 64, 65 and 67, 70 and 72 which form a spaced series of engagement members which are complementary to first flange 42 of second track 38. It is also within the scope of the present invention to mount a spaced series of engagement members such as rollers on the floor and provide a generally continuous engagement member such as a flange, complementary to the rollers, as part of the frame for supporting the web dispenser.

As shown and embodied in FIG. 1, first track 34 and second track 38 each have an angular extent of about 225° which is substantially less than the full angular extent of the path 74 around the load. This enables the load to be easily positioned by a forklift in the center of the path where it is wrapped without having to pass over a track or any other disruptive area on the floor. Similarly, it can be removed through the same area of the path. Finally, the open part of the path allows greater use of floor area near stretch wrapping device 20.

Preferably, the frame means include wheel means for vertically supporting the frame means. As shown and embodied in FIG. 1, the wheel means for vertically supporting the frame means include wheels 78, 80 and 82 which are respectively attached to track brackets 50, 54 and 56 with wheel brackets and bolts. As best shown in FIG. 3, wheel 80 is mounted on axle 84, which is attached to wheel bracket 85, which in turn is bolted to track bracket 54.

The frame means preferably includes drive means for driving the frame means relative to the second track means. It is further preferable that the drive means includes motor driven wheel means for engaging a floor and driving the frame means relative to the floor. As shown and embodied in FIG. 1, the motor driven wheel means includes motor-driven wheel 82 which engages the floor and is driven by electric motor 86 through gear train 88.

Preferably, the motor driven wheel means rotates about an axis which is perpendicular to the path. As shown and embodied in FIG. 1, motor driven wheel 82 rotates about axis 90 which is perpendicular to path 74 so that the frame means is smoothly driven around path 74.

Preferably, at least one of the leading end of the first track means and the trailing end of the second track means include guide means for guiding the leading end of this first track means into engagement with the trailing end of the second track means. As shown in FIG. 1, a funnel arrangement having two diverging flanges 92 and 94.

In operation it is seen that motor driven wheel 82 propels web dispenser 22 and first track 34 around path 74, while second track 38 guides first track 34 around path 74. From the position shown in FIG. 1, the leading end of first track 34 proceeds in a counterclockwise direction relative to the floor 46 and second track 38 such that the leading set of rollers 66 and 68 become disengaged from second track 38 while continuing to be supported above floor 46 by wheel 78. In addition, first track 34 continues to be guided around path 74 despite the disengagement between rollers 66 and 68 and second track 38 because of the continuing engagement of second track 38 with other rollers in the trailing portion of first track 34.

When leading end 95 of first track 34 comes around to engage trailing end 96 of second track 38, funnel flanges 92 and 94 ensure engagement of leading end 95 and trailing end 96 in the event of relative disalignment.

Figure 2:
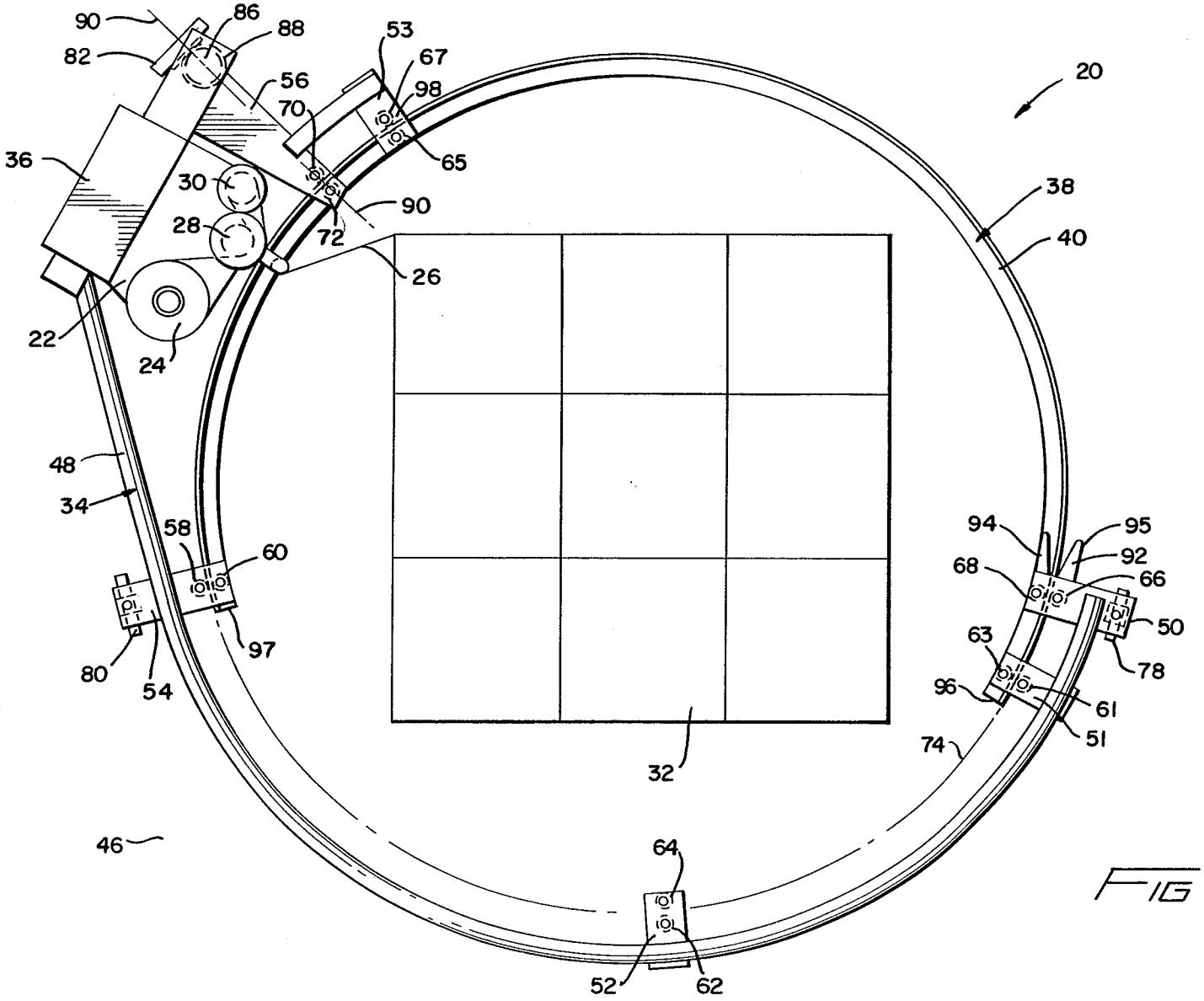
FIG. 2 is a top plan view of the wrapping device illustrated in FIG. 1, shown in a second position.

It is preferable that at least two, and even more preferably, three of the spaced series of engagement members engage the generally continuous engagement member at all positions of the frame means along the path. In FIG. 2, roller pairs 65 and 67, 70 and 72, 58 and 60, 61 and 63, 66 and 68 engage second track 38. Further movement of first track 34 in the counterclockwise direction causes roller pair 58 and 60 to disengage from second track 38 thereby leaving four roller pairs 65 and 67, 70 and 72, 61 and 63, 66 and 68 in engagement with second track 38. Greater numbers of spaced series of engagement members in the position shown in FIG. 2 causes smoother operation and greater reliability against jamming.

It is seen from this description that the present invention allows reliable and predictable movement of web dispenser 22 around path 74 in an automatic manner without having to manually guide the web dispenser nor support it from above. In addition, a substantial portion of the floor area along path 74 is not interrupted or blocked by a track so that access to the wrapping area is not blocked.

It is within the scope of the present invention to substitute either one or a series of more continuous engagement members for the spaced series of engagement members embodied by the rollers attached to first track 34. In addition, although it is preferable to drive web dispenser 22 along path 74, it is also possible for an operator to manually push the arrangement around path 74 without the aid of a motor. The motor may receive power from above or from a battery mounted on the frame.

Additional advantages and modifications will readily occur to those skilled in the art. The invention in its broader aspects is, therefore, not limited to the specific details, representative apparatus and illustrative example shown and described. Accordingly, departures may be made from such details without departing from the spirit or scope of the general inventive concept as defined by the appended claims and their equivalents.

What is claimed is:

1. Apparatus for stretch wrapping a pallet load with a web comprising:

a web dispenser disposed to travel around said load along a closed path;

frame means for supporting said web dispenser and including first track means having a leading end and a trailing end, the first track means extending along substantially less than the full angular extent of the path;

second track means mounted on a floor and disposed around said load along said path, said second track means having a leading end and a trailing end and extending along only a first portion of said path, leaving a second portion of said path open and unobstructed by the second track means and leaving the floor area along and around the second portion of the path completely unobstructed by the apparatus when both the first track means and the second track means are disposed around the first portion of the path such that the load can pass unobstructed through the second portion of the path while being transported along the floor;

complementary engagement members respectively disposed on said first and second track means for engaging each other and guiding the first track means and the web dispenser around the load along said path, and for sequentially disengaging the leading end of the first track means from the second track means, bridging the second portion of the path with the leading end of the first track means and reengaging the leading end of the track means at the trailing end of the second track means for enabling said frame means and web dispenser to travel and be guided completely around said path; and drive means mounted on the frame means and moveable with the frame means for driving said frame means along said path, the drive means including a motor driven wheel means for engaging the floor and driving the frame means relative to the floor.

2. The apparatus of claim 1 wherein at least one of the first and second track means have an angular extent of around 225°.

3. The apparatus of claim 1 wherein both the first and second track means have an angular extent of around 225°.

4. The apparatus of claim 1 wherein one of the track means includes a generally continuous engagement member and the other track means includes a spaced series of complementary engagement members.

5. The apparatus of claim 4 wherein each of the spaced series of engagement members includes at least one roller.

6. The apparatus of claim 4 wherein each of the spaced series of engagement members includes at least a pair of rollers for engaging the generally continuous engagement member between them.

7. The apparatus of claim 1 wherein the frame means includes wheel means for vertically supporting the frame means.

8. The apparatus of claim 1 wherein the motor driven wheel means rotates about an axis which is perpendicular to the path.

9. The apparatus of claim 4 wherein at least one of the leading end of the first track means and the trailing end of the second track means include guide means for guiding the leading end of first track means into engagement with the trailing end of the second track means.

10. The apparatus of claim 4 wherein at least two of the spaced series of engagement members engage the generally continuous engagement member at all positions of the frame means along the path.

11. The apparatus of claim 4 wherein at least three of the spaced series of engagement members engage the generally continuous engagement member at all positions of the frame means along the path.

12. The apparatus of claim 1 wherein the path is generally circular.

13. The apparatus of claim 1 wherein the first track means has an angular extent exceeding 180°.

14. The apparatus of claim 1 wherein the second track means has an angular extent exceeding 180°.

* * * * *